US008545066B2

(12) United States Patent
Coleman et al.

(10) Patent No.: US 8,545,066 B2
(45) **Date of Patent: *Oct. 1, 2013**

(54) ROTATING LED LIGHT ON A MAGNETIC BASE

(75) Inventors: Edward S. Coleman, Ridgefield, CT (US); Qiu Jianping, Hangzhou (CN)

(73) Assignee: Ullman Devices Corporation, Ridgefield, CT (US)

( * ) Notice: Subject to any disclaimer, the term of this patent is extended or adjusted under 35 U.S.C. 154(b) by 14 days.

This patent is subject to a terminal disclaimer.

(21) Appl. No.: 13/151,788

(22) Filed: Jun. 2, 2011

(65) Prior Publication Data

US 2011/0255274 A1 Oct. 20, 2011

Related U.S. Application Data

(63) Continuation-in-part of application No. 12/628,356, filed on Dec. 1, 2009, now Pat. No. 8,172,436.

(51) Int. Cl.
*F21S 8/00* (2006.01)

(52) U.S. Cl.
USPC ..... 362/421; 362/249.02; 362/371; 362/398

(58) Field of Classification Search
USPC ..... 362/249.01, 249.02, 249.03, 421, 362/427, 249.07, 365, 370, 371, 398, 269
See application file for complete search history.

(56) References Cited

U.S. PATENT DOCUMENTS

| | | | | |
|---|---|---|---|---|
| 4,581,686 | A | 4/1986 | Nelson | |
| 6,008,732 | A * | 12/1999 | Lam | 340/815.4 |
| 6,140,934 | A * | 10/2000 | Lam | 340/815.4 |
| 6,457,841 | B1 | 10/2002 | Lynch et al. | |
| 6,641,283 | B1 | 11/2003 | Bohler | |
| 7,367,689 | B2 | 5/2008 | Huang | |
| 2006/0061991 | A1 * | 3/2006 | Yeh | 362/250 |
| 2009/0027900 | A1 * | 1/2009 | Janos et al. | 362/373 |

* cited by examiner

*Primary Examiner* — John A Ward
(74) *Attorney, Agent, or Firm* — Bachman & LaPointe, P.C.

(57) ABSTRACT

A light includes a magnetic base; a light housing having a plurality of LEDs and a DC power source; and a frictional pivot connection between the magnetic base and the light housing.

19 Claims, 12 Drawing Sheets

ROTATING LED LIGHT ON A MAGNETIC BASE

CROSS-REFERENCE TO RELATED APPLICATION

This application is a continuation-in-part of co-pending parent application Ser. No. 12/628,356 filed Dec. 1, 2009.

This invention relates to auxiliary lighting, and more particularly, to an auxiliary puck light with a pivoting head.

Auxiliary lighting takes on many functionalities in the modern world. Lighting is needed in spaces that require visibility, such as closets, cabinets, under cabinets, tents, automobiles etc. In the working environment, a worker usually requires light in the region that he/she has to work. Either a separate person is employed to hold and direct the light or the light is hung in place. The hung light may swing or become unstable. If the light is fixed in place to avoid instability, the light is usually difficult to adjust or rotate. Changing the illuminating direction and/or region of the light is difficult. In addition, fixed lights restrict the applicable range of the light and transportation of the lighting source.

The above lights generally utilize fluorescent or incandescent lamps as a light source. Fluorescent and incandescent lamps typically require filaments and cathode tubes for operation. As such, they are fragile and have a relatively short operating life. Furthermore, filament lamps are not the most economical to operate. In addition, by producing light by heating a filament, incandescent lamps generate a great deal of heat. This heat build up limits the effectiveness of traditional auxiliary lighting due to safety considerations and the possibility of unintentionally and adversely heating items in the near vicinity. This heat generation also makes traditional puck lights less versatile in that some places in which such a light would be desired cannot accommodate a large buildup of heat (e.g. closets, shelves, etc.). Moreover, traditional incandescent and fluorescent lights are quite inefficient. Incandescent lights convert a large amount of energy to heat rather than light, and fluorescent lamps have a relatively high start up power consumption.

Light Emitting Diodes (LEDs) are solid-state semi-conductor devices that convert electrical energy into light. LEDs are made from a combination of semi-conductors and generate light when current flows across the junctions of these materials. The color of the light produced by the LED is determined by the combination of materials used in its manufacture. LEDs have made significant advances in providing a higher performing light source since their inception. For example, red-emitting AlGaAs (aluminum gallium arsenide) LEDs have been developed with efficacies greater than 20 lumens per electrical watt, such devices being more energy efficient and longer lasting producers of red light than red-filtered incandescent bulbs. More recently, AlGalnP (aluminum gallium indium phosphide) and InGaN (indium gallium nitride) LED's have succeeded ALGaAs as the brightest available LEDs. As a result, LEDs have become cost effective replacements for standard incandescent light sources in various applications, such as automotive brake lights, roadway work zone safety lights and red stoplights. It would be advantageous to provide an LED light source for auxiliary lighting, which replaces the traditional filament or fluorescent lamp with an LED light source.

SUMMARY OF THE DISCLOSURE

The primary object of the present disclosure is the creation of a rotating LED light on a magnetic base.

A further object of the present disclosure is the creation of an illumination system that includes an LED module or housing and a mounting base. A plurality of LEDs are mounted on the housing to serve as a light source and generates a light pattern. The housing can be easily rotated about the base unit to provide a rotatable mounting architecture. A battery system provides power to the LEDs.

BRIEF DESCRIPTION OF THE DRAWINGS

A detailed description of preferred embodiments of the present invention follows, with reference to the attached drawings, wherein.

DETAILED DESCRIPTION

This disclosure is drawn to a puck shaped LED light with a rotating magnetic base.

Figure 1:
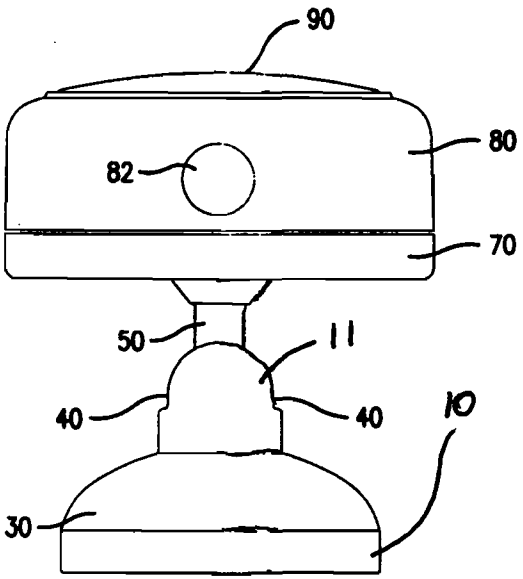
FIG. 1 illustratively depicts the auxiliary light source.

FIG. 1 details the puck shaped auxiliary light of the present disclosure. 10 depicts a magnetic base of the light attached to base 30. Post 50 and post holder 11 pivotably connect a light housing 80 to base 30. Notches 40 on both sides of the opening of post holder 11 are designed to fit post 50. The LED puck shaped housing 80 is threadedly attached to housing bottom 70, which is attached by any means well known within the art to post 50. Top 90 is the transparent window of the light.

The auxiliary light of the present invention may be made from any materials that are well known within the art. For instance, the base 30 may be composed of acrylonitrile butadiene styrene (ABS) plastic resin, the magnetic base 10 may be composed of a sturdy rubber or plastic material, the housings 80 and 70 may be composed of color anodized aluminum, ABS, mixtures thereof or the like and the post 50 may be composed of nylon resin, such as PA6+30% GF, steel alloy, such as carbon steel, mixtures thereof or the like.

Figure 2:
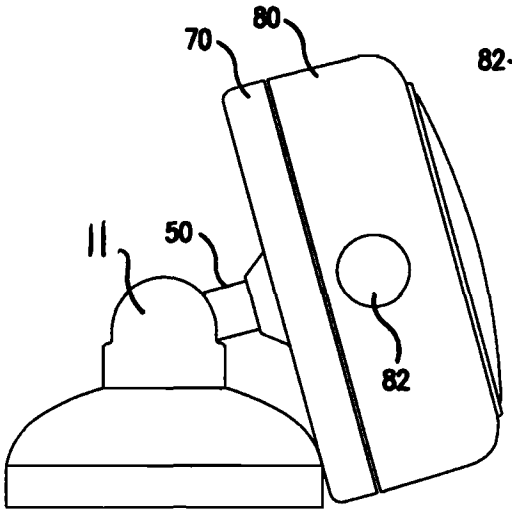
FIG. 2 illustratively depicts the rotational movement of the auxiliary light source.
Figure 12:
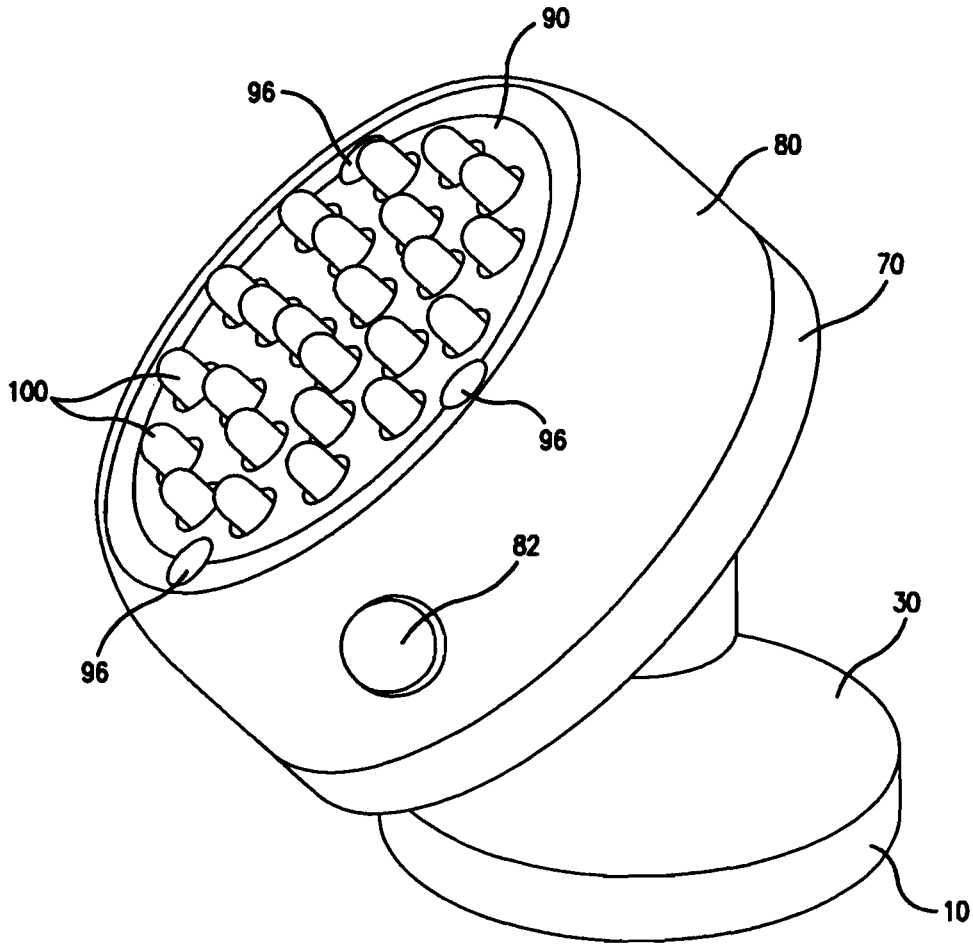
FIG. 12 illustratively depicts the far most pivot position of the auxiliary light source.

On/Off switch 82 contacts batteries located inside housing 80 in order to activate the electrical connection supplied to LED lights arranged at the top of housing 80. See FIG. 4. FIGS. 2 and 12 depict post 50 in one of the furthest pivoting positions. Notch 40 on each side of post 50 is designed to extend far enough into base 30 so that housing bottom 70 will hit base 30 when the pivot post 50 is in the furthest position.

Figure 5A:
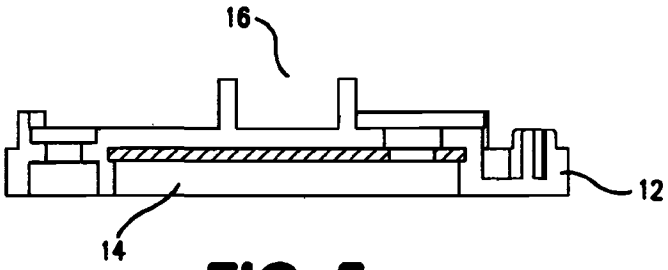
FIG. 5*a* illustratively depicts the magnet housing of the auxiliary light source.
Figure 5B:
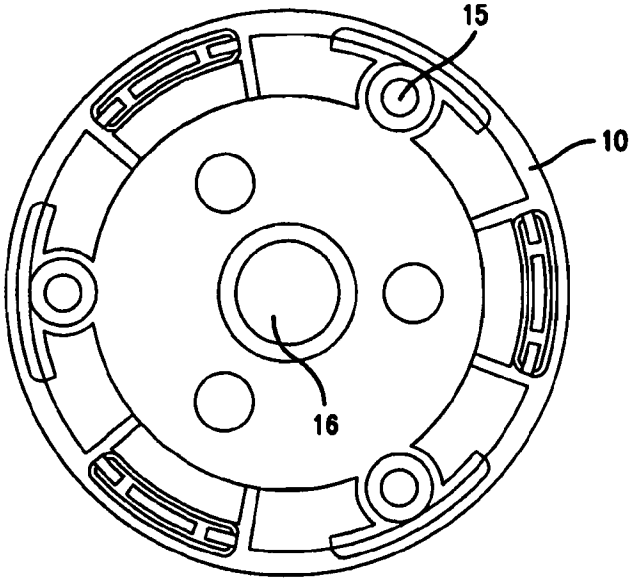
FIG. 5*b* illustratively depicts a top view of magnetic base of the auxiliary light source.
Figure 4:
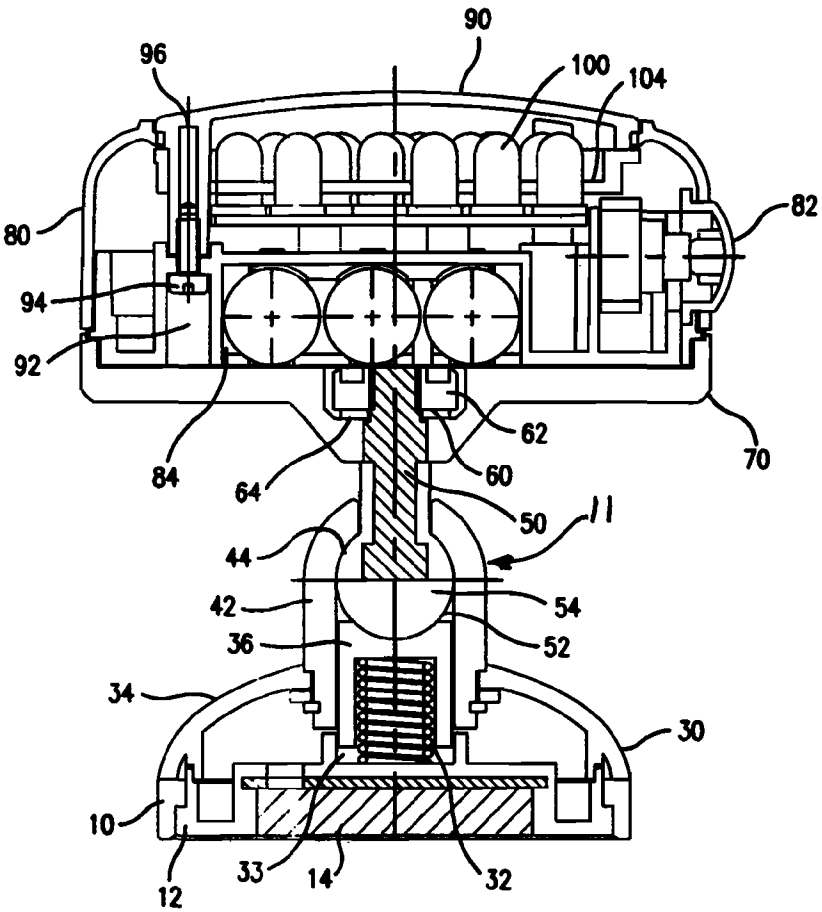
FIG. 4 is a cross-sectional view of the auxiliary light and a non-limiting embodiment of the rotation apparatus and connection of the rotation apparatus on the housing bottom of the auxiliary light source.
Figure 6A:
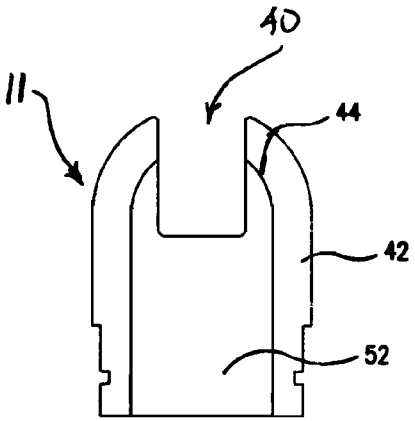
FIG. 6*a* illustratively depicts the spaced support walls of the auxiliary light source.
Figure 6B:
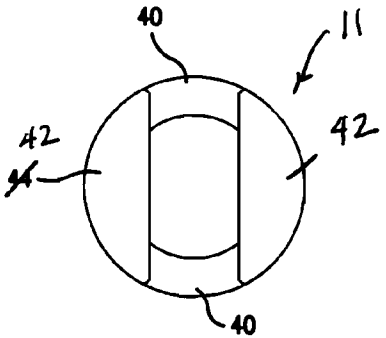
FIG. 6*b* illustratively depicts a top view of the spaced curvature of the support walls and rotation support notches of the auxiliary light source.

FIG. 4 depicts one embodiment of the present invention. Base 30 is attached to magnetic base 10, which defines a magnet housing 12 for a magnet 14. The magnet housing 12 also defines a receptacle 16 for holding spring 32. FIG. 5*a* shows a side view of magnet housing 12. FIG. 5*b* shows a top view of magnetic base 10, which surrounds the top of magnet housing 12. As shown in FIGS. 4, 6*a*, 6*b*, 7*a* and 7*b*, the receptacle may be defined by two upstanding spaced walls 42 preferably having curved inner surfaces 44 closely matched to the shape of a balled end 54 of post 50. Upstanding walls 42 define an inner chamber 52 which holds an upper housing support system. FIG. 6*b* shows a top view of the spaced walls 42 with the curved inner surfaces 44 and notches 40 in relation to curved inner surfaces 44.

FIG. 4 shows upstanding walls 42 attached by any means that is well known within the art to base 30 defining inner chamber 52 which slidably holds a piston 36 which can have an end 38 shaped to match balled end 54 of post 50. A spring 32 biases piston 36 against balled end 54 so as to frictionally hold balled end 54 in a desired location relative to base 30.

Figure 10A:
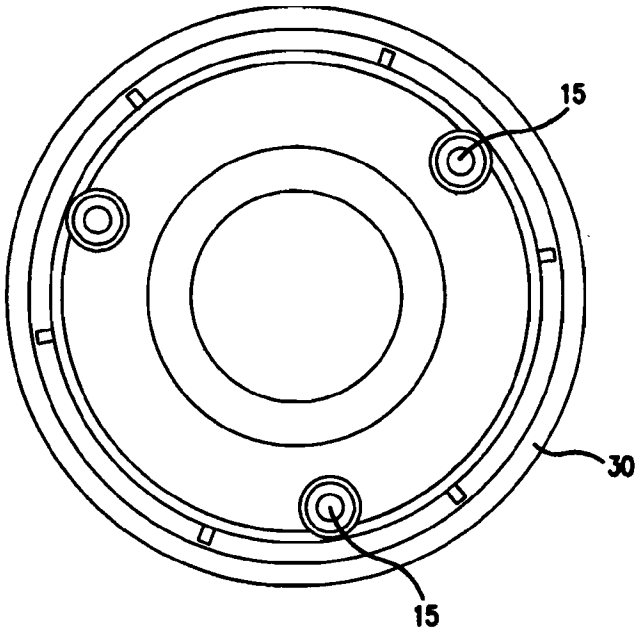
FIG. 10*a* illustratively depicts a bottom view of the inside of base of the auxiliary light source.
Figure 10B:
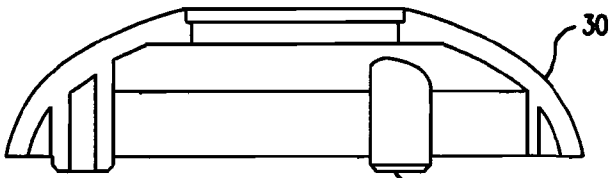
FIG. 10*b* illustratively depicts the base of the auxiliary light source.

Continuing on FIGS. 4, 6*a*, 7*a*, 8 and 9, spring 32 is positioned to bias piston 36 to hit the rounded posterior end 54 of post 50. Spring 32, as part of the support assembly, adds stability and strength to post 50 to frictionally hold post 50 in a position to which it is pivoted relative to base 30. At its bottom, base 30 is attached to magnet base 10 and magnet housing 12 by screws through screw holes 15 (See also FIGS. 5*b* and 10*a-c*). FIG. 10*a* shows a bottom view of housing 30, FIG. 10*b* shows a cross sectional side view of housing 30 and FIG. 10*c* shows a partially cross sectional side view of the screw attachment 15 of magnet base 10 and magnetic housing 12 to base 30.

Figure 3:
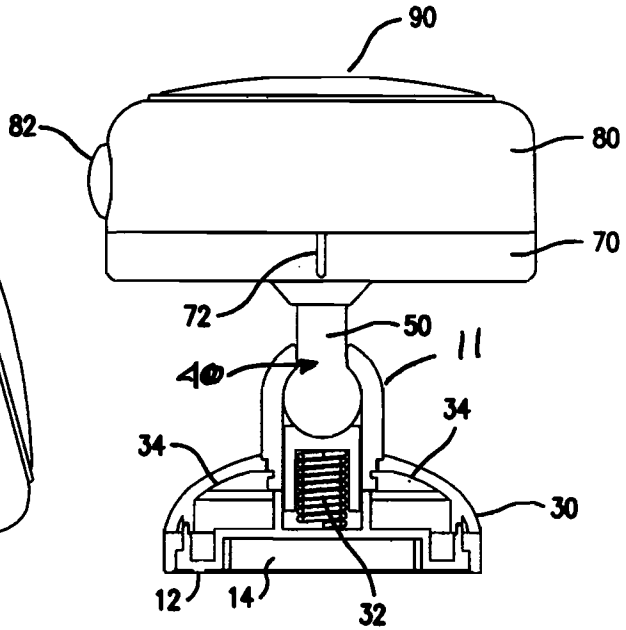
FIG. 3 illustratively depicts a cross-sectional view of the rotation apparatus of the auxiliary light source.

FIG. 3 also shows a marker 72. Marker 72 is used to determine the open/closed position of threadedly attached housing bottom 70 to housing 80 (See also FIG. 16).

Figure 8:
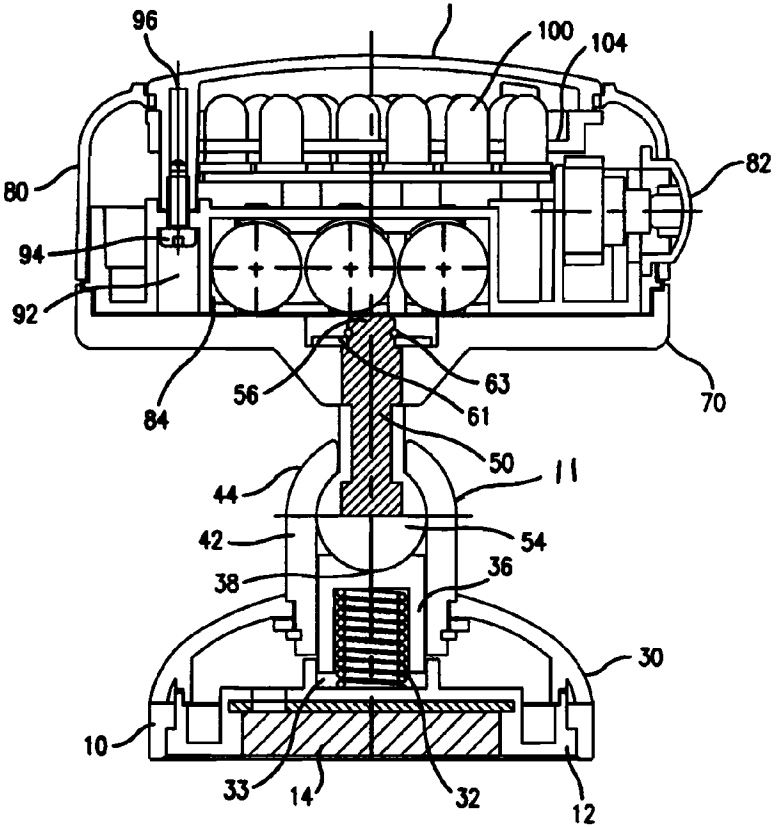
FIG. 8 illustratively depicts the auxiliary light and a non-limiting embodiment of the rotation apparatus and connection of the rotation apparatus on the housing bottom of the auxiliary light source.
Figure 7A:
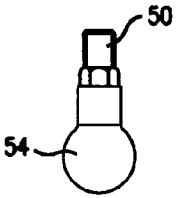
FIG. 7*a* illustratively depicts the rotation apparatus of the auxiliary light source.
Figure 7B:
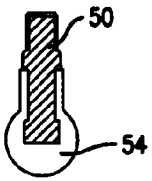
FIG. 7*b* illustratively depicts the rotation apparatus of the auxiliary light source.
Figure 7C:
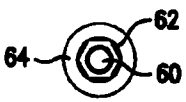
FIG. 7*c* illustratively depicts a top view of the connection of the rotation apparatus to the bottom housing of the auxiliary light source.
Figure 9:
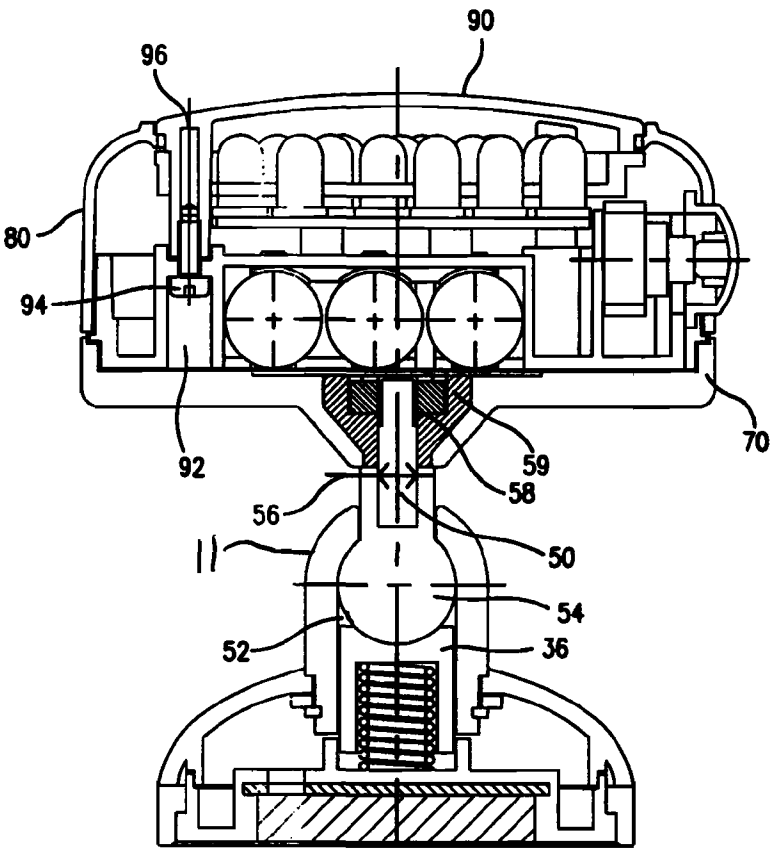
FIG. 9 illustratively depicts the auxiliary light and a non-limiting embodiment of the rotation apparatus and connection of the rotation apparatus on the housing bottom of the auxiliary light source.
Figure 10C:
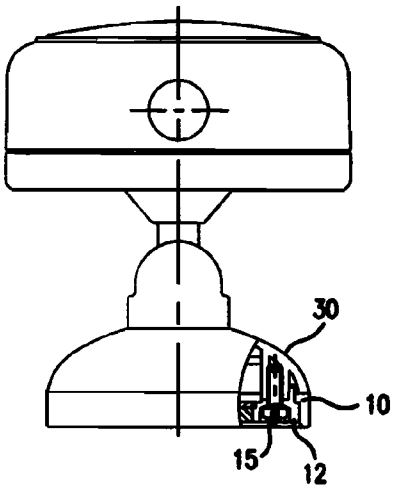
FIG. 10*c* illustratively depicts the connection of the magnet housing and magnetic base to the base of the auxiliary light source.

FIGS. 4, 8 and 9 depict a cross section of the auxiliary light. In the FIG. 4 embodiment, the post 50 and balled end 54 are made through injection molding. Post 50 is composed of any metal or resin that is well known within the art, such as a steel alloy, i.e. carbon steel. Ball 54 is made from plastic and/or any suitable material that is well known within the art, such as nylon resin. The post 50 and ball 54 assembly are illustrated in the non limiting embodiment of FIG. 4 and FIG. 7*c* as connected to the housing bottom 70 by a threaded screw 60, nut 62, and anti-slip washer 64 connection assembly.

FIG. 8 depicts a cross section of the auxiliary light. In this non-limiting embodiment, the post 50 and balled end 54 are also made through injection molding. The post 54 is molded to have an end 56 shaped to fit a snap ring 63. In this embodiment, the post 50 and ball 54 assembly are connected to the housing bottom 70 by snap ring 63 and a flexible washer 61 connection assembly.

FIG. 9 depicts a cross section of the auxiliary light. In this non-limiting embodiment, the post 50 and balled end 54 are also made through injection molding. The post 50 is shaped with an outward flange 59 and embedded in the ball 54 then threadedly attached 58 to ball 54. This embodiment increases the strength of the post 50 and ball 54 assembly by reinforcing the small diameter 56 of post 50. In this embodiment, the assembly of post 50 and ball 54 is connected with screws 58 to the housing bottom 70.

Figure 11A:
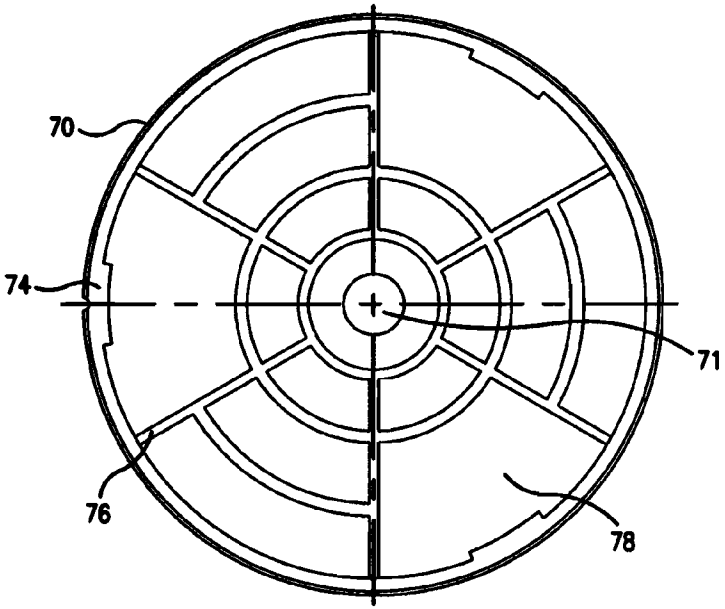
FIG. 11*a* illustratively depicts a top view of the housing bottom of the auxiliary light source.
Figure 11C:
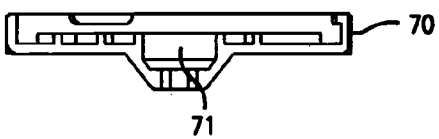
FIG. 11*c* illustratively the housing bottom of the auxiliary light source.
Figure 11B:
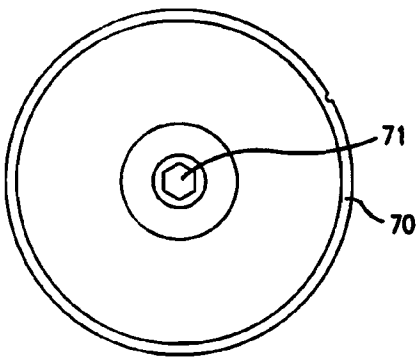
FIG. 11*b* illustratively depicts a bottom view of the housing bottom of the auxiliary light source.

FIGS. 11*a-c* depict the housing bottom 70 of the auxiliary light. FIG. 11*a* depicts the top of housing bottom 70. The housing bottom 70 is designed to threadedly connect to housing 80 by latch tabs 74. For increased strength and stability, vertical reinforcement lines 76 are added to the top of housing bottom 70. In order to create latch tabs 74, the top of the housing bottom also has empty spaces 78 associated with the spacing of latch tabs 74. FIG. 11*b* depicts the bottom of housing 70. FIG. 11*c* depicts a side view of housing bottom 70. Housing bottom 70 is attached to post 50 by screw, latch or any connection method or assembly that is well known within the art, in the location of 71.

FIG. 12 depicts the auxiliary light at its furthest pivot position. Housing top 80 threadedly attached to bottom 70 is pivoted until bottom 70 rests upon base 30. Housing top 80 contains LEDs 100 protected by top 90. Top 90 includes receptacles 96 designed to correspond to housing holes 92 (See FIGS. 4, 8, 9, 13 and 19). As described below, receptacles 96 and holes 92 serve in the connection of top 90 to housing 80.

Figure 14:
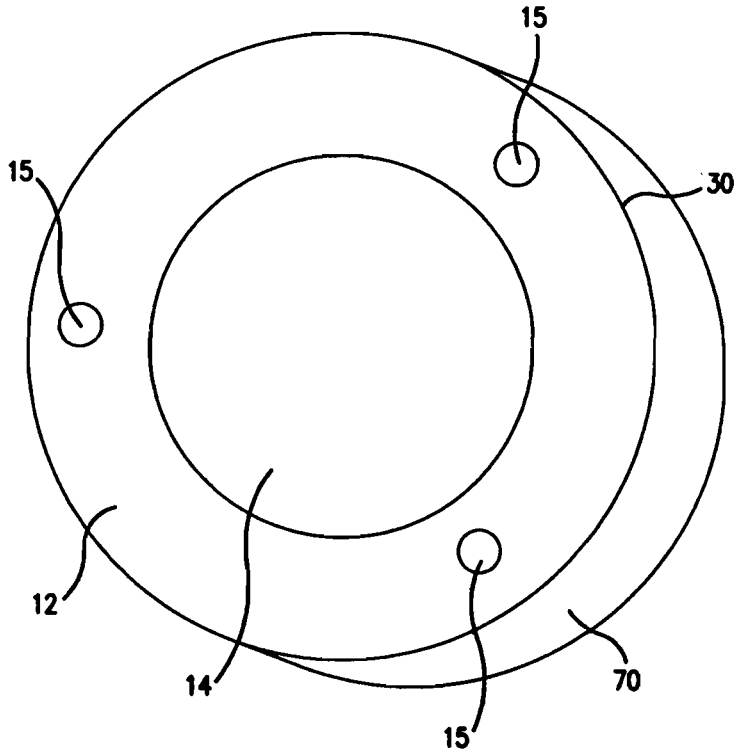
FIG. 14 illustratively depicts a bottom view of the magnetic housing including the magnet of the auxiliary light source.
Figure 15:
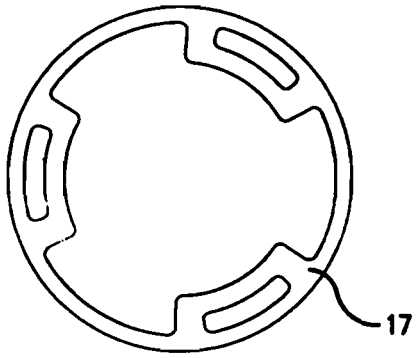
FIG. 15 illustratively depicts the magnet support of the auxiliary light source.

FIGS. 5*b*, 10*c*, 14 and 15 detail the attachment of the magnet 14 to magnet housing 12. FIG. 14 shows a bottom view of the auxiliary light fully assembled. A rubber support ring 17 (FIG. 15) is placed inside the hollow within magnet housing 12, and magnet 14 is attached to the inside of magnet housing 12 by any method that is well known within the art, such as by glue, screw, tape, mixtures thereof and the like. Once magnet 14 is firmly attached to magnet housing 12, as shown in FIG. 10*c*, magnet housing 12 is covered by magnetic base 10 and housing 12 and magnetic base 10 are screw connected through openings 15 to base 30. The strength of magnet 14 is determined by the size, shape and nature of the auxiliary light. In preferred embodiments, the magnet is strong enough to securely and fixedly hold the auxiliary light on any ferrous or magnetic surface regardless of the orientation of the light as compared to gravitational forces. Preferably, the magnet strength is 5 to 10 lbs.

Figure 16:
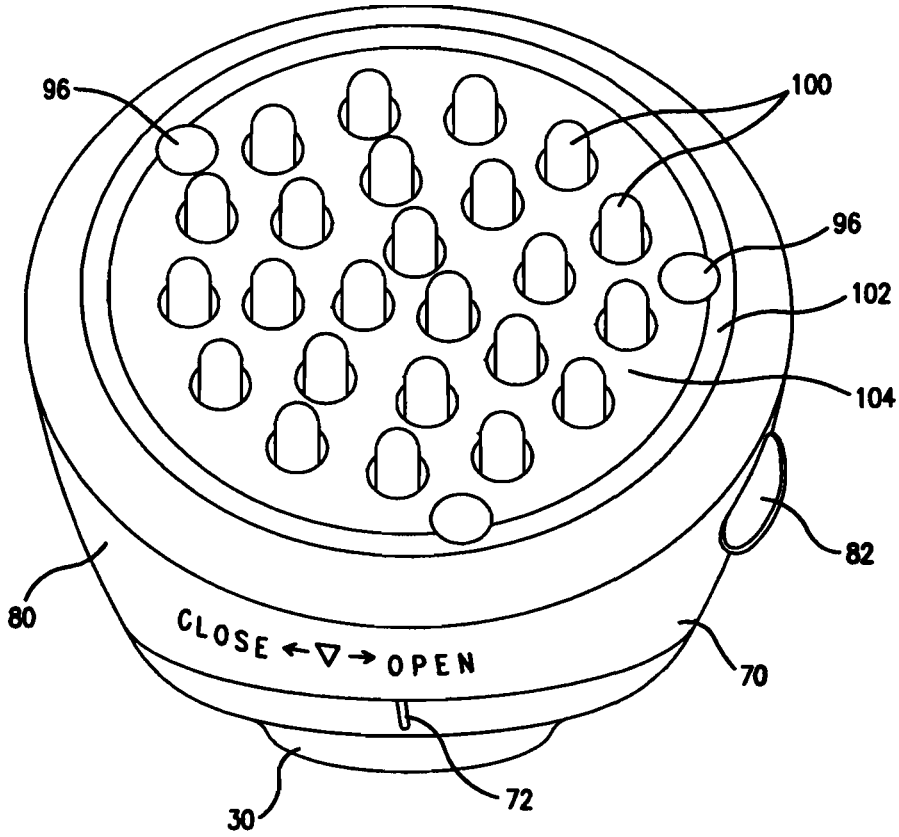
FIG. 16 illustratively depicts a top view of the auxiliary light source.
Figure 17B:
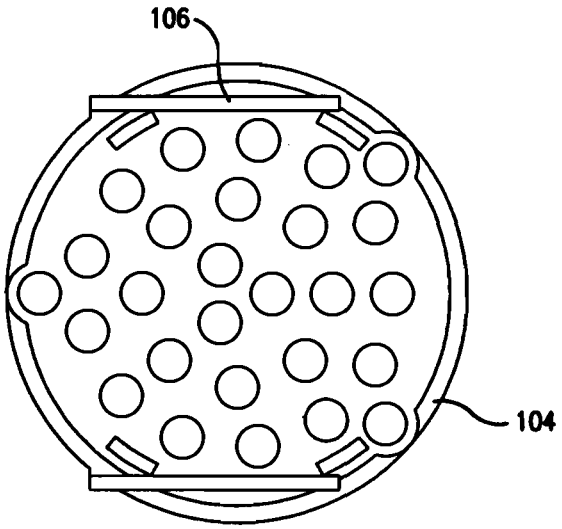
FIG. 17*b* illustratively depicts a bottom view of the reflective plate of the auxiliary light source.
Figure 17C:
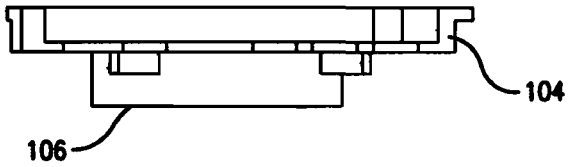
FIG. 17*c* illustratively depicts the reflective plate of the auxiliary light source.
Figure 17A:
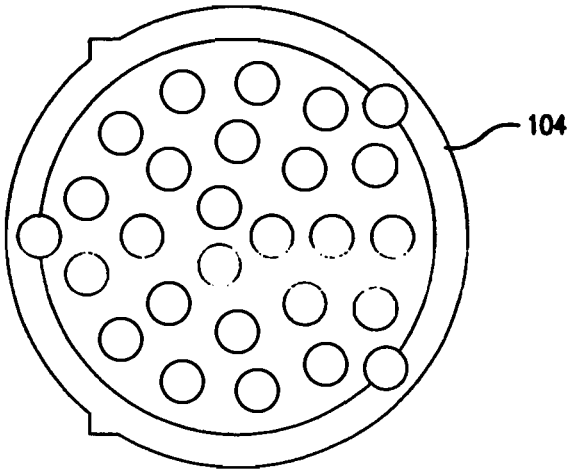
FIG. 17*a* illustratively depicts a top view of the reflective plate of the auxiliary light source.

FIGS. 4, 8, 9, 12, 16, 17*a-c*, 18 *a-b* and 19 depict the top housing 80 of the present invention. In FIG. 16, LEDs 100 are surrounded by metallic cover 102 and arranged on a reflective plate 104. The reflective plate 104 rests atop the metallic cover on supports 106. FIGS. 18*a-b* depict a top view 18*a* and cross sectional side view 18*b* of metallic cover 102. The metallic cover 102 may be made from any metal that is well known within the art, such as aluminum. FIGS. 17*a-c* depict a top 17*a*, bottom 17*b* and side view 17*c* of reflective plate 104. The reflective plate 104 may be any material that has the ability to reflect light, such as a mirror, a sheet of foil, mixtures thereof or the like.

Figure 13B:
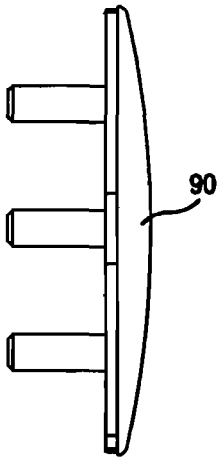
FIG. 13*b* illustratively depicts a side view of the transparent protective top of the auxiliary light source.
Figure 13A:
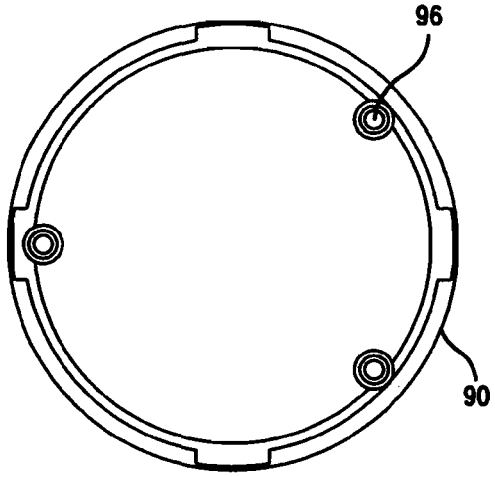
FIG. 13*a* illustratively depicts a bottom view of the transparent protective top 90 of the auxiliary light source as claimed.
Figure 13C:
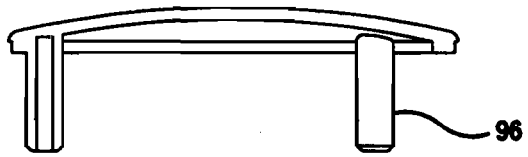
FIG. 13*c* illustratively depicts the transparent protective top of the auxiliary light source.

Top 90 includes tubular screw attachments 96. FIGS. 13*a-c* show a side view 13*b*, a bottom view 13*a* and a cross sectional side view 13*c* of top 90 with tubular screw attachments 96. These tubular screw attachments 96 are designed to correspond to housing holes 92. As seen in FIGS. 4, 8, 9, 13 and 19, holes 92 travel through housing 80 to battery compartment 84. Screws 94 through holes 92 into attachments 96 are used to secure top 90 to housing 80. Top 90 may be made from any transparent material that is well known within the art, such as transparent polycarbonate resin (PC), transparent PC/ABS resins, mixtures thereof and the like.

Figure 19:
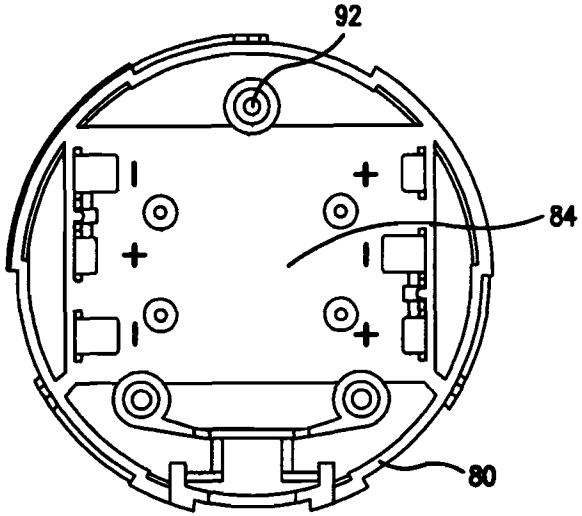
FIG. 19 illustratively depicts a top view of the battery compartment of the auxiliary light source as claimed.
Figure 18A:
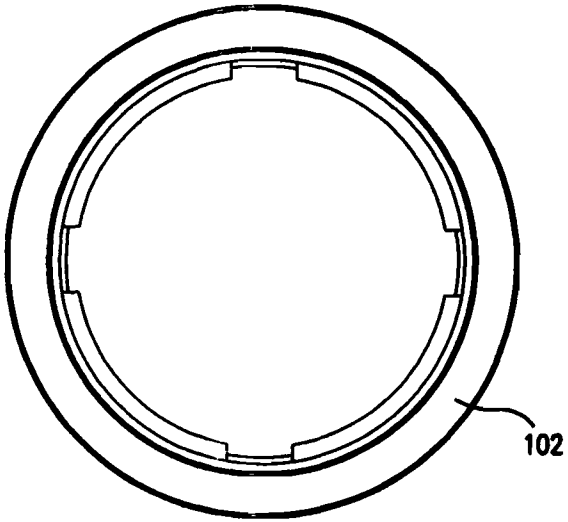
FIG. 18*a* illustratively depicts a top view of the metallic cover of the auxiliary light source.
Figure 18B:
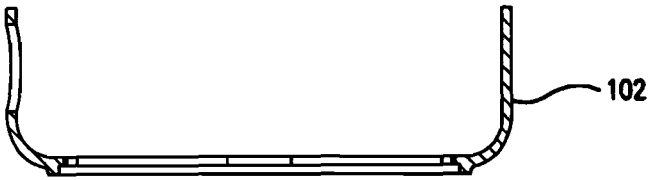
FIG. 18*b* illustratively depicts the metallic cover of the auxiliary light source.

FIG. 19 shows the battery compartment 84 of the present invention. Housing 80 contains the electrical connections for the proper operation of the on/off switch 82 and the LEDs 100. The electrical connection within housing 80 utilized to operate and power the LEDs may be any configuration that is well known within the art.

In addition, the auxiliary light of the present invention may also contain an AC power adapter/recharger for providing AC power to the LEDs and for recharging the DC power source. In addition, the power may be regulated with a switch that can control the level of intensity output of the LEDs.

Figure 20:
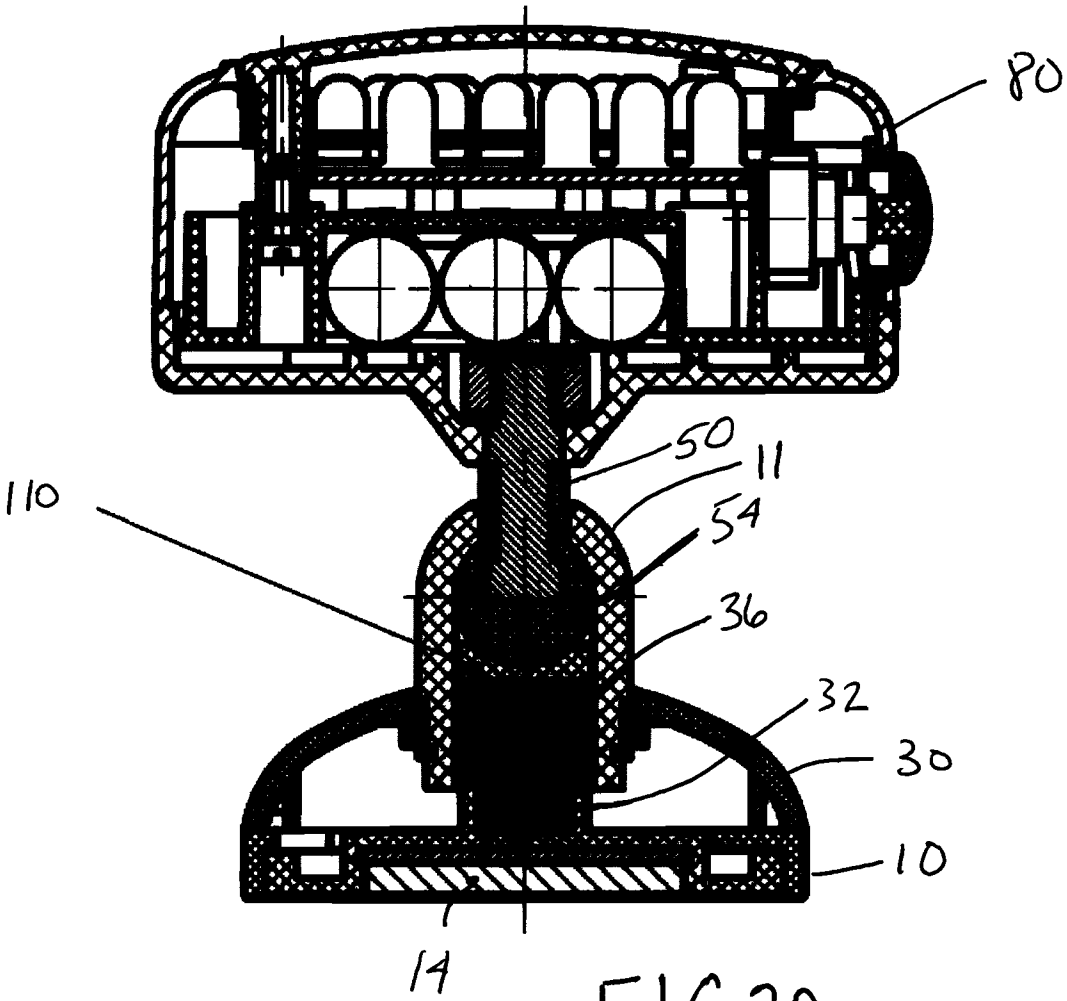
FIG. 20 illustrates an alternate embodiment of the rotation apparatus according to the invention.

FIG. 20 shows a further embodiment of the present invention wherein additional support to hold the light in a pivoted position relative to the base is provided.

In the embodiments of FIGS. 4, 8 and 9, the light member is held relative to the base by frictional forces between piston 36 and balled end 54 of post 50. In accordance with the present invention, however, these frictional forces are increased by providing a rubber washer 110 between piston 36 and balled end 54. In this way, force exerted by spring 32 upon piston 36 exerts a greater holding force between washer 110 and balled end 54 to more securely hold the light in a proper position with respect to the base. Washer 110 can be provided of any suitable material which has a sufficient frictional hold on balled end 54, and one suitable material is rubber.

It should be appreciated that in all embodiments, light housing 80 can be pivoted relative to base 30 between the positions of FIG. 1 and FIG. 2, and can also be rotated relative to base 30 for example through rotation of post 50 and/or post holder 11 relative to base 30. This provides a desirable amount of freedom in directing light to an area of interest.

It is to be appreciated that the various components of the present invention may be connected by any means that is well known within the mechanical arts. The multiple components multiple components of the present invention may be threadedly attached, screw attached, glue attached, lock joint with snap ring attached, snapped together, mixtures thereof and the like.

The assembly of the present disclosure may be implemented in other possible applications. The final characteristics of the lighting assembly may be applied to any application that may benefit from the novel properties of the present disclosure. For example, the lighting housing maybe any shape, design or size that may be reasonably associated with the novel rotational mounting. In addition, the LEDs may be incorporated to exhibit any color arrangement as desired for any particular purpose.

It is to be understood that the present disclosure is not limited to the illustrations described and shown herein, which are deemed to be merely illustrative of the best modes of carrying out the invention, and which are susceptible of modification of form, size, arrangement of parts and details of operation. The present disclosure rather is intended to encompass all such modifications which are within its spirit and scope as illustrated by the figures and defined by the claims.

What is claimed is:

1. A light, comprising:

a magnetic base;

a light housing having a plurality of LEDs and a DC power source; and a pivot assembly connected between the magnetic base and the light housing, the pivot assembly comprising a pivot post having a ball defined at one end, and spaced support walls defining an inner chamber housing the ball, and further comprising a compression member positioned to exert a holding force on the ball at a location other than the pivot post.

2. The apparatus of claim 1, wherein said DC power source is rechargeable.

3. The apparatus of claim 1, further comprising an AC power adapter/recharger for providing AC power to said plurality of LEDs and for recharging said DC power source.

4. The apparatus of claim 1, further comprising a switch for controlling a level of light output by the LEDs.

5. The lighting assembly according to claim 1, wherein the LEDs are high intensity white light LEDs.

6. The apparatus of claim 1, wherein the compression member comprises a spring biased piston exerting a holding force on the ball of the pivot post.

7. The apparatus of claim 6, wherein the spaced support walls are rotatable relative to the base, and wherein the pivot post is pivotable relative to the spaced support walls.

8. The apparatus of claim 6, wherein the piston has an end having a shape which corresponds to the ball.

9. The apparatus of claim 6, wherein the spring holds the pivot post in a position relative to the base by biasing the piston against the ball of the pivot post.

10. The apparatus of claim 6, further comprising a washer between the pivot post and the piston.

11. The apparatus of claim 10, wherein the washer is rubber.

12. The apparatus of claim 1, wherein the spaced support walls define a gap, and wherein the pivot post can pivot along the gap relative to the base.

13. The apparatus of claim 1, wherein the spaced support walls have curved inner surfaces closely matched to the shape of the ball of the pivot post.

14. The apparatus of claim 1, wherein the magnetic base comprises a magnet, and wherein the strength of the magnet is 5 to 10 lbs.

15. The apparatus of claim 1, wherein the base is composed of acrylonitrile butadiene styrene (ABS) plastic resin.

16. The apparatus of claim 1, wherein the magnetic base is composed of a rubber.

17. The apparatus of claim 1, wherein the housing is composed of a material selected from the group consisting of color anodized aluminum, ABS, and mixtures thereof.

18. The apparatus of claim 1, wherein the pivot post is composed of a material selected from the group consisting of nylon resin, steel alloy or combinations thereof.

19. The apparatus of claim 1, further comprising a transparent housing top covering the LEDs.

* * * * *